United States Patent [19]

Froid

[11] Patent Number: 4,951,409

[45] Date of Patent: Aug. 28, 1990

[54] SHOTGUN CHOKE WRENCH AND CASE

[75] Inventor: Daniel Froid, Garden Grove, Calif.

[73] Assignee: Qwikee Products, Inc., Mineral Wells, Tex.

[21] Appl. No.: 262,819

[22] Filed: Oct. 26, 1988

[51] Int. Cl.[5] ..... F41C 27/00

[52] U.S. Cl. ..... 42/90; 81/125

[58] Field of Search ..... 42/79, 90; 81/125, 436, 81/442

[56] References Cited

U.S. PATENT DOCUMENTS

| | | | |
|---|---|---|---|
| 1,281,928 | 10/1918 | Fifield | 81/125 |
| 1,793,477 | 2/1931 | German et al. | 85/176.15 |
| 2,649,825 | 8/1953 | Fisher | 81/125 |
| 2,834,241 | 5/1958 | Chowning | 81/125 |
| 3,227,015 | 1/1966 | Tremblay | 81/177 |
| 4,736,540 | 4/1988 | Holmes | 42/90 |
| 4,837,962 | 6/1989 | Longerot | 42/90 |

FOREIGN PATENT DOCUMENTS

| | | | |
|---|---|---|---|
| 730710 | 6/1941 | Fed. Rep. of Germany | 81/125 |
| 225670 | 12/1924 | United Kingdom | 81/125 |

OTHER PUBLICATIONS

Advertisement for "Choke Tube Thread Cleaner", *Shotgun Sports.*

Advertisement for Remington "Model 11-87 Premier Choke Tubes and Special Wrench".

Advertisement for "Choke Tube Speed Wrench", Aug. 1988, *Shotgun Sports.*

Advertisement for "ChoKeeper".

*Primary Examiner*—Charles T. Jordan

*Attorney, Agent, or Firm*—Knobbe, Martens, Olson & Bear

[57] ABSTRACT

A shotgun choke wrench and case for installing, storing and removing shotgun chokes. The shotgun choke wrench and case comprises: an outer tube that acts as a wrench handle and a container, and an inner element that is a wrench and is also capable of holding a choke. The shotgun choke wrench and case also comprises a detent ball or a push button and spring as a retaining mechanism and a pair of ball bearings for ease of movement and guidance when the inner part extends out of the outer tube. The shotgun choke wrench and case has two positions, the case position and the wrench position. In the case position, the outer tube serves as a container while the inner part which holds onto a choke fits completely inside the outer tube to form the base of the container. In the wrench position, the inner part extends from the outer tube, holds the choke and acts as a wrench to install or remove the choke from the barrel of the shotgun.

9 Claims, 2 Drawing Sheets

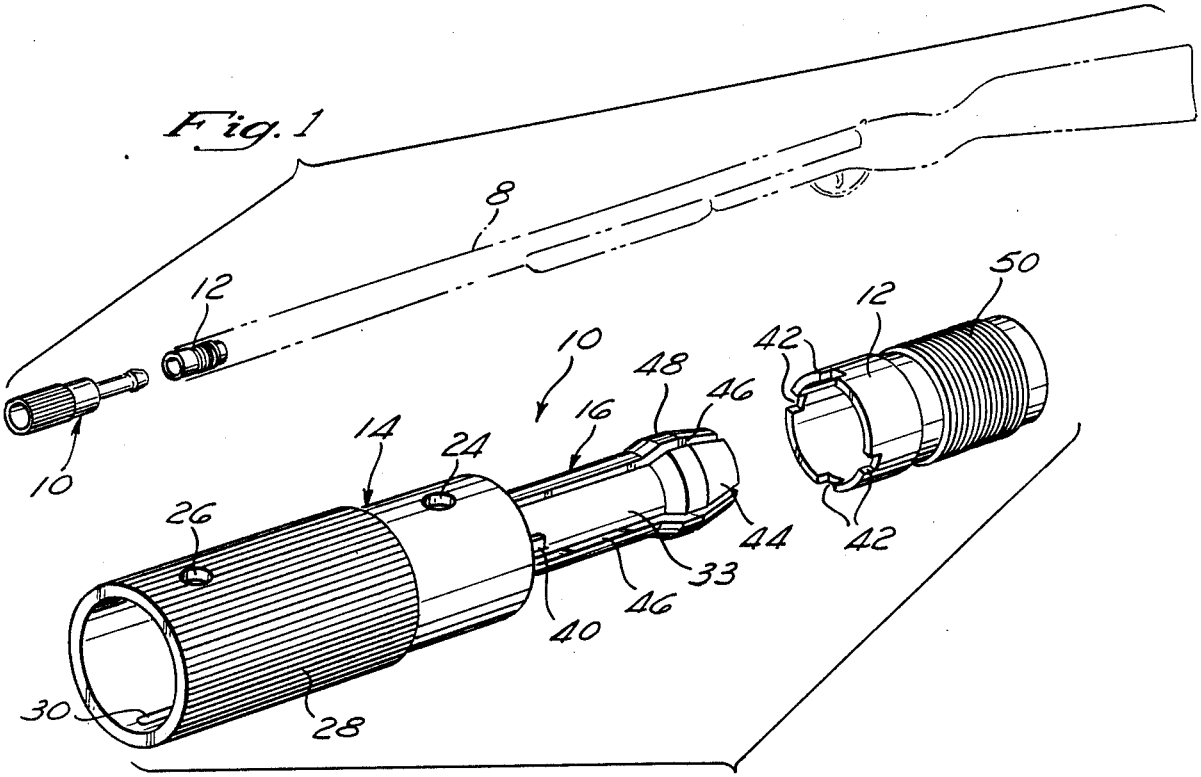
Fig. 1
Fig. 2
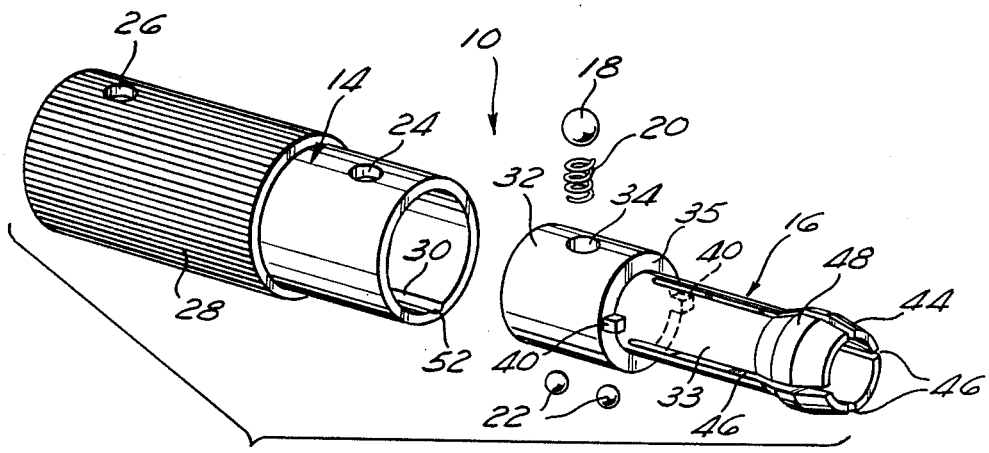
Fig. 3
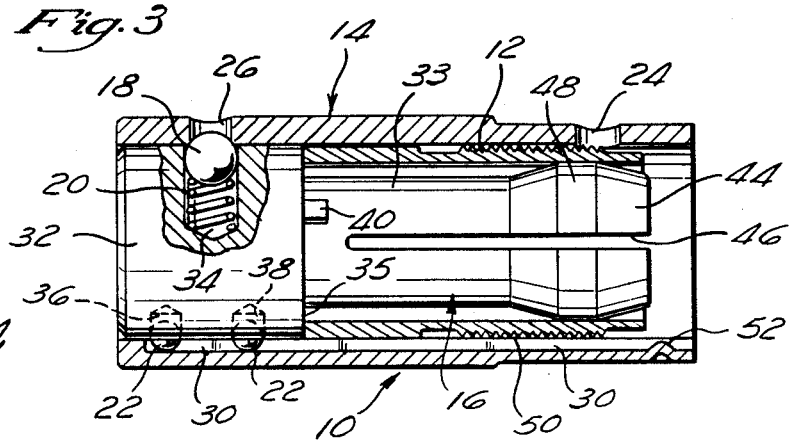
Fig. 4

SHOTGUN CHOKE WRENCH AND CASE

BACKGROUND OF THE INVENTION

This invention relates to an apparatus that is both a wrench and a storage container. In particular, the present invention functions as both a shotgun choke wrench for installing and removing shotgun chokes that screw into the barrel of a shotgun, and as a storage case for chokes.

Many conventional shotguns have threads on the inside of the outboard end of the barrel. This permits the barrels to receive choke tubes. The outside end of each choke tube has threads that screw into corresponding threads on the inside of the shotgun barrel. A shotgun choke is typically a hollow metal cylinder with a narrowing taper extending from its widest point at the end of the choke facing the shotgun stock to its narrowest point at the other end of the choke. Different choke tubes have different amounts of taper. The amount of taper on a choke is used to vary the pattern of the shot as it is discharged from the barrel of the shotgun. The ability to control the pattern of the shot by interchanging various chokes enables a shooter to use the same shotgun for various applications such as both trap and skeet shooting.

Most chokes have two or more slots at the end opposite the threaded end to lock with the drive lugs of a conventional choke wrench for tightening and loosening the choke within the shotgun barrel. To change chokes, a shooter unscrews the choke inside the barrel with a choke wrench and then removes the choke by hand. Next, the shooter screws a new choke in by hand and then uses the choke wrench to tighten the new choke in the barrel of the shotgun.

During use chokes can get very hot and dirty because they are located inside the barrel of the shotgun. Thus, when a shooter changes chokes, his or her hands usually will get dirty from handling the chokes and it can be very difficult to handle the chokes when they are hot.

SUMMARY OF THE INVENTION

The present invention overcomes these problems by providing an apparatus that allows the user to install, remove and store a shotgun choke without having to touch the choke at all. This is advantageously accomplished by providing a case having an opening sized to hold a shotgun choke and an inner choke holder connected to the case for movement in and out of the case. The inner holder has elements which permit the retaining of a shotgun choke. A shotgun choke wrench member is also provided and is connected with the outer part such that the outer part and the choke wrench member rotate together.

In a further aspect of the invention the case is a cylindrical tube and the inner choke holder slides within the tube from a position in which the majority of the inner part is within the tube to an open position wherein a majority of the inner part is outside the tube.

In a further aspect of the invention, the inner part includes resilient fingers extendable from the outer part for contact with the interior walls of a shotgun choke to hold the choke in position during installation, removal and storage.

In a further aspect of the invention a thumb button sized to fit through a slot in the outer tube is provided to permit extension and retraction of the inner holder by using a thumb movement.

In a further aspect of the invention a method of removing or installing and storing a shotgun choke is disclosed. In accordance with the invention the user may install a shotgun choke by opening a choke wrench and holder to the open position; placing the choke into the barrel of the shotgun; screwing the choke into the shotgun barrel; and then removing the choke wrench and case from the choke. The removal of the choke can be accomplished by reversing the above-referenced steps.

Thus, in accordance with the invention, a method and apparatus is disclosed which permits a shotgun choke to be installed or removed and stored without any need to touch the shotgun choke itself in the process.

BRIEF DESCRIPTION OF THE DRAWINGS

FIG. 1 illustrates a perspective view of the shotgun choke wrench and case of the present invention, a shotgun shown in phantom, and a choke installed in the shotgun;

FIG. 2 illustrates a perspective view of the shotgun choke wrench and case of the present invention in the open position along with a shotgun choke;

FIG. 3 illustrates an exploded view of the shotgun choke wrench and case of the present invention;

FIG. 4 is a side elevation, partially in section view of the shotgun choke wrench and case of the present invention in the closed position storing a shotgun choke inside.

DESCRIPTION OF A PREFERRED EMBODIMENT

Figure 5:
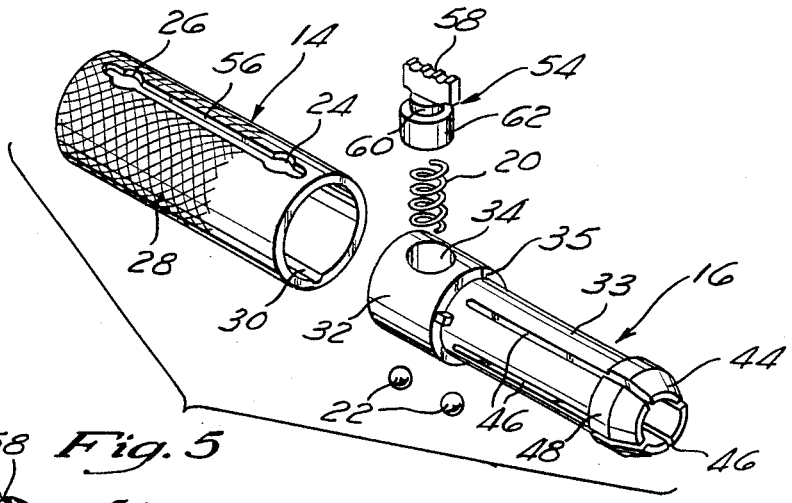
FIG. 5 illustrates an exploded view of an alternate embodiment of the present invention which employs a push button instead of a detent ball.

A preferred embodiment of the present invention will now be disclosed in detail with reference to FIGS. 1-4 of the drawings. As seen in FIG. 1, a shotgun choke 12 is typically a metal tube that is placed in the barrel of a shotgun 8. There are a set of threads 50 on one end of the exterior wall of the choke 12 that allow it to be screwed onto matching treads on the barrel of the shotgun 8. Each choke 12 is constructed with some taper so that the outboard end of the choke 12 has a smaller inner diameter than the inner diameter of the barrel of the shotgun 8. The greater the amount of taper the narrower the shot pattern. Thus, chokes 12 make shotguns 8 more versatile because the shot pattern can be varied by using chokes 12 with different amounts of taper.

As will be understood from the discussion that follows, a choke wrench and case 10 made in accordance with the present invention is designed to enable the user to remove the choke 12 from the shotgun 8, and also serve as a case for the choke 12. The preferred embodiment of the present invention advantageously has the ability to remove the shotgun choke 12 from the outboard end of the barrel without requiring that the user touch the choke 12. Once the choke 12 has been removed, the device also serves as a case in which to store the choke 12. Therefore, it is an advantage of the present invention to provide a shotgun choke wrench and case 10 that can be used to change the choke 12 and enclose it within a case without having to touch the choke 12.

It is a further advantage of the present invention to provide a shotgun choke wrench and case which is easy to operate and simple to manufacture.

The present invention uniquely combines a shotgun choke wrench and a shotgun choke case into one apparatus. FIGS. 2 and 3 illustrate the shotgun choke wrench and case 10 of the present invention. In a preferred embodiment, the shotgun choke wrench and case 10 of the present invention comprises: an outer tube 14, an inner part 16, a detent ball 18, a spring 20 and a pair of track ball bearings 22. Additionally, the shotgun choke wrench and case 10 may also contain a cap (not shown). This cap would be placed over the unenclosed end of the outer tube 14 when the present invention acts as a case for the choke 12.

The outer tube 14 comprises a tube or thin-walled cylinder that may be advantageously constructed of any suitable material including metal or plastic. In the preferred embodiment the outer tube 14 is advantageously made of 60-61 T6 aluminum. The exterior 28 of the outer tube 14 is advantaqeously textured with tiny grooves which make the exterior 28 rough and prevent the device from slipping in the hands of the shooter when used to screw or unscrew the choke 12. The textured exterior 28 advantageously forms a knurl grip or a diamond grip for when the outer tube 14 is used as a wrench handle. In the preferred embodiment, the inner diameter of the outer tube 14 is uniform throughout the entire length of the tube 14, however, the outer diameter is not. Approximately onethird of the length of the outer tube 14 has a slightly smaller outer diameter than the rest of the outer tube 14.

The inner part 16 has a general cylindrical shape that allows it to fit within the outer tube 14. The inner part 16 has a length slightly shorter than the outer tube 14. The inner part 16 is comprised of three sections: a base section 32, a middle section 33 and an end section 44. All three sections lie on the same central axis and have approximately equal lengths. All sections have a cylindrical shape, but each has a different diameter. It should be understood that the lengths and diameters of the outer tube 14 and inner part 16 can be varied accordingly for any number of different sized chokes.

There are also a pair of holes 24 and 26 through the wall of the outer tube 14. These two holes 24 and 26 serve as retaining positions for the detent ball 18. The two holes 24 and 26 lie on a longitudinal line that is parallel to a lengthwise line through the center of the outer tube 14. The two holes 24 and 26 are located on the line close to opposite ends of the tube 14. One hole 24 is located close to the end of the outer tube 14 from which the inner part 16 extends, while the other hole 26 is located close to the opposite end. One hole 26 retains the inner part 16 in the closed position where the present invention acts as a case for the shotgun choke 12. The other hole 24 retains the inner part 16 in the open position where the present invention acts as a choke wrench.

On the interior surface of the outer tube 14 there is a groove 30. The groove 30 runs along a longitudinal line continuously from one end of the outer tube 14 to the other. The grove 30 is located on the interior of the outer tube 14 directly across from where the two holes 24 and 26 enter the interior of the outer tube 14. The groove 30 and holes 24 and 26 are positioned such that a plane intersecting with the holes 24 and 26, and the line along which the groove 30 lies would divide the outer tube 14 in half. This groove 30 serves as a guide for the inner part 16 when it moves from the closed position to the open position and vice versa. The groove 30 on the outer tube 14, the inner part 16 and the track ball bearings 22 fit together to guide the inner part 16 when changing positions, and to provide ease of movement from one position to another. The detent ball 18 and the track ball bearings 22 also assure that the inner part 16 and the outer tube 14 will turn together when torque is applied to screw and unscrew the choke 12 from the barrel of the shotgun 8.

As briefly mentioned above, the inner part 16 comprises three sections along its length. The base section 32 of the inner part 16 is a solid cylinder that fits snugly within the outer tube 14. The diameter of the base section 32 of the inner part 16 is about the same as the inner diameter of the outer tube 14, and both are slightly greater than outer diameter of the choke 12. The middle section 33 of inner part 16 has an outer diameter which is smaller than the inner diameter of the choke 12 so that it may fit within the choke 12. Since the diameter of the middle section 33 is smaller than the diameter of the base section 32, there is a ridge 35 on the base section 32 created where the two sections meet. The diameter of the base section 32 is slightly greater than the diameter of the choke 12. Thus, the choke 12 is able to slide completely over the middle section 33 until it reaches the base section 32 where it is stopped by the ridge 35 of the base section 32.

The middle 33 and end 44 sections of the inner part 16 have advantageous features that allow the inner part 16 to hold onto the choke 12. While a particular embodiment is described below, it should be understood that the middle 33 and end 44 sections of the inner part 16 can be constructed in other ways which allow the inner part 16 to hold onto a shotgun choke such as with a clamp, or any expandable end section. The middle 33 and end 44 sections are hollowed to form a cylinder that is partially tube-like. Additionally, there are four slits 46 in the inner part 16 about the same length as a shotgun choke 12 forming four resilient fingers. These slits 46 run parallel to each other along the length of the inner part 16 through the middle 33 and end 44 sections only, and are spaced equally apart from each other on the circumference of the inner part 16. The middle section 33 has a uniform diameter smaller than the diameter of the choke 12. In contrast, the diameter of the end section 44 ranges from a diameter the same size as the middle section 33 to a diameter slightly larger than the choke 12. At each end, the diameter of the end section 44 is equal to the diameter of the middle section 33. In the middle of the end section 44 there is a larger diameter area 48 which has a diameter slightly greater than the inner diameter of the choke 12. As you move toward the middle of the end section 44 the diameter gradually increases until it is equal to the diameter of this larger diameter area 48. Even though this larger diameter area 48 may be greater than the inner diameter of the shotgun choke 12, it is still able to fit snugly inside the choke 12 and hold the choke 12 because the slits 46 and the hollowed area permit the circumference of the larger diameter area 48 to be reduced to fit within the choke 12. The larger diameter area 48 is resilient to reductions in its diameter. Thus, when the larger diameter area 48 is forced into the choke 12, it must gradually reduce its diameter which in turn creates an outward force that holds the choke 12. The force is created because the natural tendency of the larger diameter area 48 is to remain at a diameter that is greater than the inner diameter of the choke 12. To provide easy entry into the choke 12, the present invention advantageously provides a narrowing taper at the very end of the section 44. If the end section 44 did not have a smaller diameter at the very end, it would prevent the inner part 16 from sliding inside the choke 12 because the larger diameter area 48 would not fit inside the choke 12. An advantage of the preferred embodiment of the present invention is the gradual increase in the diameter of the end section 44 from the smaller diameter to the larger diameter. This gradual increase allows the shooter to insert the inner part 16 into the choke 12 as well as force the diameter of the end section 44 to reduce.

Figure 6:
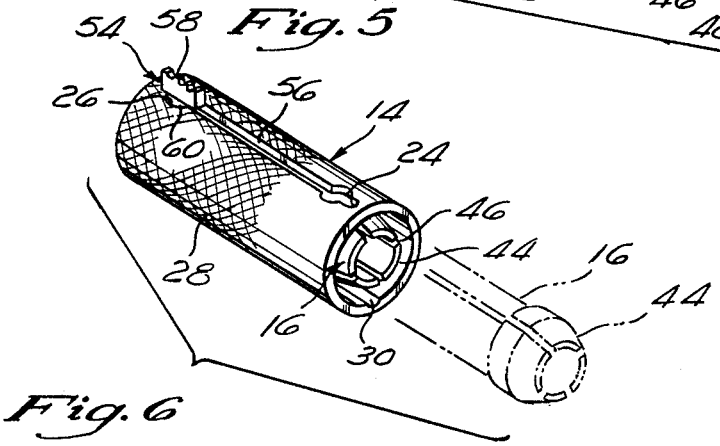
FIG. 6 illustrates a perspective view of the alternate embodiment of the present invention in the closed position.
Figure 7:
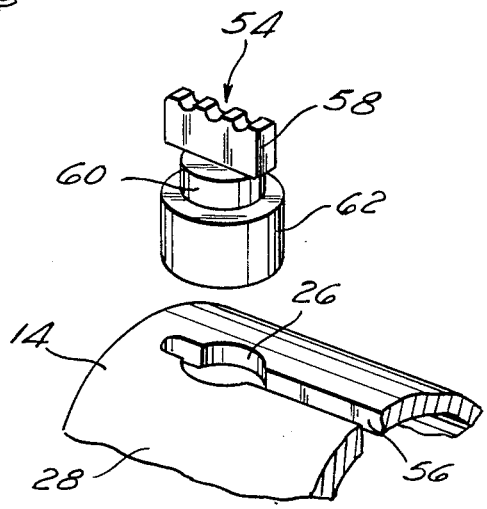
FIG. 7 illustrates an exploded view of the push button and a section of the alternate embodiment of the present invention.
Figure 8:
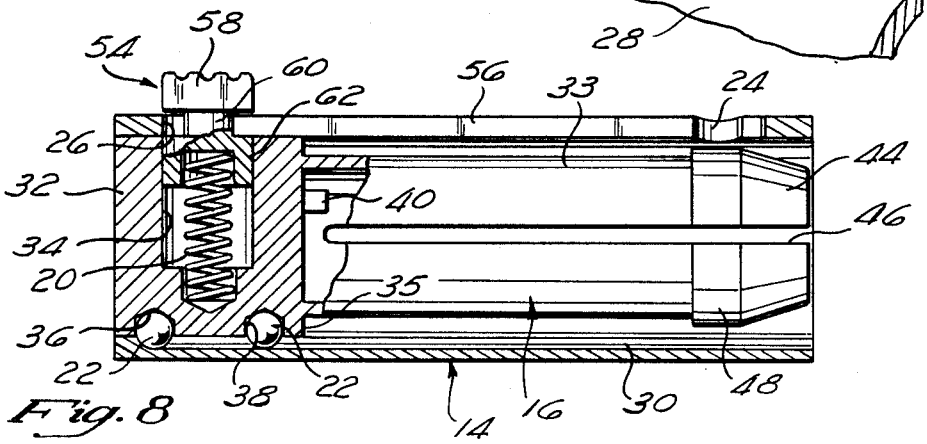
FIG. 8 illustrates a side elevation, partially in section view of the shotgun choke wrench and case of the present invention in an alternate embodiment and in the closed position.

At a midpoint in the length of the base section 32, there is a hole 34 from the exterior wall of the inner part 16 inward to the center. A line through the center of the hole 34 would be perpendicular to a center axis running the length of the inner part 16. The hole 34 is positioned to correspond with the positions of the two holes 24 and 26 on the outer tube 14. This hole 34 provides the housing for the detent ball 18 and the spring 20, as illustrated in FIG. 4. In an alternate embodiment shown in FIGS. 5-8, a push button 54 may be substituted in place of the detent ball 18. The spring 20 is placed inside the hole 34 with the detent ball 18 placed upon the spring 20, but also inside the hole 34. If a push button 54 is used, it would sit upon the spring 20 just as the detent ball 18, but only part of the push button 54 is inside the hole 34. Because of pressure from the spring 20, the detent ball 18 is forced out of the hole 34 and towards the interior of the outer tube 14. When in the closed position, the force of the spring 20 pushes the detent ball 18 so that it sits in the hole 26 on the outer tube 14. Similarly, when in the open position, the detent ball 18 is forced partially into the hole 24 on the other end of the outer tube 14. Thus, the detent ball can be in two positions: 1) released such that the inner part 16 is in transition between the open and closed positions; or 2) retained in one of the two holes 24, 26 on the outer tube 14.

As illustrated in FIG. 4, the inner part 16 has a pair of additional holes 36 and 38 on the exterior of the base section 32. These holes 36 and 38 are positioned on the opposite side of the base section 32 from where the hole 34 for the detent ball 18 is located. These holes 36 and 38 lie on a longitudinal line that runs the parallel to an axis through the center of the inner part 16. The holes 36 and 38 are spaced apart from each other with approximately half of the length of the base section 32 between them. Like the hole 34 for the detent ball 18, the holes 36 and 38 extend inwardly and are perpendicular to a center axis of the inner part 16. These holes 36 and 38 house the two track ball bearings 22 corresponding to the groove 30 on the inside of the outer tube 14. The holes 36 and 38 are made to position the track ball bearings 22 at a preset depth. The two track ball bearings 22 fit within the holes 36 and 38 and the groove 30, such that the inner part 16 is allowed to slide freely in and out of the outer tube 14. While the groove 30, the bearings 22, and the holes 34 and 36 allow easy movement, they also prevent the inner part 16 from coming completely out of the outer tube 14 and from rotating or turning inside of the outer tube 14. The inner part 16 cannot slide completely out of the outer tube 14 because of the construction of the groove 30 and a lock 52 in the groove 30 On one end of the outer tube 14, the groove 30 terminates slightly before the end of the outer tube 14. This prevents the inner part 16 from sliding out of the outer tube 14 because the track ball bearings 22 cannot slide any further than the end of the groove 30. However, on the other end the lock 52 is needed because the groove 30 does not terminate before the end of the outer tube 14. The groove 30 is purposely made this was so that the inner part 16 can easily be inserted into the outer tube 14 during the manufacturing process. The lock 52 is a bump created in the groove 30. The bump acts just like the end of the groove 30 to stop the track ball bearings from sliding, and thus, prevents the inner part 16 from sliding out of the outer tube 14. The bump is made by punching the outer tube 14 inward at a position on the exterior 28 of the outer tube 14 such that a bump is formed in the groove 30. In this way, the holes 36 and 38, the track 30 and the ball bearings 22 interact to assure that the inner part 16 and the outer tube 14 turn together when the present invention is used as a wrench.

The wrench part of the inner part 16 is comprised of a pair of drive lugs 40. The drive lugs 40 are two small tabs which extend radially on opposite sides of the exterior of the middle section 33. The drive lugs 40 are located on the ridge 35 between the base section 32 and the middle section 33 of the inner part 16. These two drive lugs 40 are spaced equally apart along the circumference of the middle section 33 of the inner part 16. The drive lugs 40 register with the slots 42 on the outboard end of the choke 12 so the choke 12 can be screwed or unscrewed when these drive lugs 40 are placed in a pair of slots 42 on the choke 12.

In an alternate embodiment, as shown in FIGS. 5-8, the detent ball 18 is replaced by a push button 54. The push button 54 requires some minor modifications to the embodiment described above, but the operation of each is basically the same. The push button 54 is a tab 58 connected on top of a small cylinder 60 which is in turn connected on top of a large partially hollowed cylinder 62. The large cylinder 62 of the push button 54 has a diameter equal to the diameter of the hole 34 in the base section 32 of the inner part 16. The large cylinder 62 of push button 54 is housed in the hole 34 on the inner part 16 with the smaller cylinder 60 and tab 58 extending radially outward from the hole 34. The diameter of the smaller cylinder 60 of the push button 54 matches the diameter of the holes 24 and 26 in the outer tube 14. The diameter of the holes 24 and 26 in the outer tube 14 is smaller than the diameter of the larger cylinder part 62 of the push button 54. The difference in diameters assures that the larger cylinder part 62 of the push button 54 will remain in the inner part 16 and prevent the push button 54 from coming completely out of the hole 34 in the inner part 16. The tab 58 is connected on top of the smaller diameter part 60 of the push button 54. This tab 58 enables the user to change the position of the shotgun choke wrench and case 10 by moving the tab 58 to a retained position in either of the holes 24 and 26 on the outer tube 14. The spring 20 forces the push button 54 towards the outer tube 14 so that the inner part 16 is retained in two possible positions when the smaller cylinder 60 is forced into either of the two holes 24 and 26. In order to accommodate the push button 54, the outer tube 14 is modified from the description above by creating a slot 56 just wider than the tab 58 of the push button 54. The slot 56 runs lengthwise from the hole 24 on one end of the outer tube 14 to the other hole 26 on the outer tube 14. The slot 56 goes slightly past each hole 24 and 26 in each direction. The slot 56 has a width smaller than the diameter of either hole 24 and 26 in the outer tube 14. This keeps the smaller diameter part 60 of the push button 54 inside the outer tube 14 except when the choke wrench and case 10 is in either retained position. When depressed, the push button 54 can slide within the slot 56 on the outer tube 14 since the tab 58 of the push button 54 has a width slightly less than the width of the slot 56. However, when the push button 54 is not depressed and is retained in either hole 24 or 26 of the outer tube 14 the push button 54 cannot slide within the slot 56 because the diameter of the smaller cylinder part 60 of the push button 54 is greater than the diameter of the slot 56.

The alternative embodiment has a number of advantages over the embodiment with the detent ball 18. One advantage is that the lock 52 on the end of the groove 30 is not needed for the embodiment with the push button 54. This saves a lot of time in the manufacture of the shotgun choke wrench and case 10. Also, the embodiment with the push button 54 allows the choke wrench and case 10 to be disassembled for cleaning. Cleaning is much easier because the inner part 16 can be taken completely out of the outer tube 14 by putting the choke wrench and case 10 in the open position and then depressing the push button 54 so that the entire push button 54 including the tab 58 is inside the hole 34 in the inner part 16. The user is then able to slide the inner part 16 completely out of the outer tube 14 by pulling the inner part 16 away from the outer tube 14.

The open position for the shotgun choke wrench and case 10 is illustrated in FIGS. 1 and 2. In the open position, the present invention acts as a wrench to screw or unscrew the choke 12 as well as to install or remove it from the barrel of a shotgun 8. A special feature of this invention is its ability to hold the choke 12 because of the unique shape of the inner part 16 as described above. The shotgun choke wrench and case 10 is held in the open position by the detent ball 18, the spring 20 and the hole 24 on the outer tube 14.

FIG. 4 illustrates a cross-sectional view of the choke wrench and case 10 serving as a case for a shotgun choke 12 when in the closed position. The entire inner part 16 as well as the shotgun choke 12 covering the middle 33 and end 44 sections fits within the outer tube 14 in the closed position.

The shotgun choke wrench and case 10 performs three basic functions: removal of the choke 12; storage of the choke 12; and installation of the choke 12.

The first function of the present invention is the removal of the choke 12. One of the first steps required to remove the choke 12 is to put the empty shotgun choke wrench and case 10 in the open position. Typically, the choke wrench and case 10 will be in the closed position because its reduced size makes it easier to handle. To move the choke wrench and case 10 from the closed position to the open position, the user must apply pressure to the base 32 of the inner part 16 while holding the outer tube 14 in place. Applying pressure to the base 32 of the inner part 16 releases the retaining mechanism and forces the detent ball 18 out of the hole 26 on the outer tube 14 in which it sits to a position completely inside the hole 34 in the inner part 16. Pressure is applied to the base 32 of the inner part 16 until it is fully extended from the outer tube 14 in the open position. When the inner part 16 reaches the open position the detent ball 18 is forced by the spring 20 partially into the hole 24 on the outer tube 14 to retain the inner part 16 in the open position.

Once the choke wrench and case 10 is in the open position, the user will hold onto the outer tube 14 and force the inner part 16 into the choke 12 installed in the barrel of the shotgun 8. The user will push the inner part 16 into the choke 12 until the drive lugs 40 on the inner part 16 make contact with the end of the choke 12 with the slots 42. The user then turns the outer tube 14 while forcing the inner part 16 into the choke until the drive lugs 40 of the inner part 16 register with the slots 42 of the choke 12. As described above, the outer tube 14 and the inner part 16 move together, thus, turning the outer tube 14 will rotate the drive lugs 40 until they fit in the slots 42 on the choke. The user then continues turning the outer tube 14 in a manner that will unscrew the choke 12 from the barrel of the shotgun 8. After the choke 12 has been completely unscrewed, it is detachable and can be removed from the shotgun 8. Because of the advantageous design of the present invention, the shotgun choke wrench and case 10 will be in the open position holding onto the choke 12. Never in the removal process is the user require to touch the shotgun choke 12.

The second function of the present invention is storing the choke 12. To store the choke 12, one must only move the shotgun choke wrench and case 10 from the open position to the closed position since it already holds the choke 12 after removal. Moving the present invention from the open position to the closed position requires that the user hold the outer tube 14 while applying pressure to the end 44 of the inner part 16. For example, the user may hold on to the outer tube 14 and strike the end section 44 of the inner part 16 against anything such as his or her other hand or a table. This forces the inner part 16, surrounded by the choke 12, to slide into the outer tube 14. The force on the inner part 16 also pushes the detent ball 18 out of the hole 24 on the outer tube 14 to a position completely inside the hole 34 in the inner part 16. The pressure is applied until the inner part 16 reaches the closed position. The inner part 16 is retained in the closed position with the detent ball 18 being force partially into the hole 26 in the outer part 14. In the closed position, the device acts as a case for the choke 12 with the outer tube 14 functioning as the walls of the protective container and the inner part 16 acting as the base of the protective container. After the device is in the closed position the choke 12 can be completely enclosed by placing the cap (not shown) on the end of the outer tube 14 from which the inner part 16 slides out.

The removal and storage of the choke 12 from the barrel of the shotgun 8, is accomplished in a similar fashion with the alternate embodiment of the present invention which utilizes a push button 54 in place of the detent ball 18. The only difference between the operation of the two embodiments is the way in which one changes the choke wrench and case 10 from the open position to the closed position and vice versa. For the embodiment with the detent ball 18, force is applied to either the base section 32 or the end section 44 when changing the position of the device. For the embodiment with the push button 54, changing positions is done by moving the tab 58 of the push button 54 along the slot 56 in the outer tube 14. This movement may advantageously be accomplished by using the thumb. For example, to change the choke wrench and case 10 from the open position to the closed position, the user first depresses the push button 54 forcing the smaller cylinder part 60 of the push button 54 inward and out of the hole 24 on the outer tube 14. Depressing the push button 54 releases the inner part 16 from being retained in the open position. The user then may use his or her thumb to slide the inner part 16 into the outer tube 14 by applying pressure to the tab 58 of the push button 54 such that the push button 54 moves along the slot 56 in the outer tube 14 toward the other hole 26 in the outer tube 14. The inner part 16 is forced to slide into the outer tube 14 as the push button 54 is moved across the length of the outer tube 14 because the force applied to the push button 54 is indirectly applied to inner part 16 since the hole 34 in the inner part 16 houses the push button 54. Once the push button 54 reaches the hole 26 on the other end of the outer tube 14, the user releases the push button 54 and the spring 20 in the hole 34 on the inner part 16 forces the smaller cylinder part 60 of the push button 54 into the hole 26 on the outer part 14 where the push button 54 retains the inner part 16 in the closed position.

Another basic function of the present invention is installing the choke 12 into the shotgun 8. Normally the present invention will be in a closed position storing a choke which the user wishes to install into the shotgun 8. To install the choke 12, the user must first change the position of the shotgun wrench and case 10 from the closed position to the open position. This has been discussed at length above, and thus, there is no need to repeat the discussion here. The procedure is the same even though the inner part 16 now holds the choke 12. Again, the present invention does not require that the user hold the choke 12 because this is done by the unique design of the inner part 16. Once the present invention is in the open position the user simply puts the choke 12 in the barrel of the shotgun 8 and rotates the outer tube 14 to screw in the choke 12. Using the choke wrench and case 10, the user then tightens the choke 12 until it is installed. Then the outer tube 14 is pulled away from the barrel of the shotgun 8 such that the inner part 16 is pulled out from its position inside the choke 12. Once this has been done the choke 12 is installed and the user may return the choke wrench and case 10 to the closed position for storage.

In light of the above, it can be appreciated that the present invention advantageously allows the user to use the choke wrench and case 10 first to remove the choke 12 from the barrel of the shotgun 8, and then to store it without ever having to touch the choke 12. This is often an advantage since the choke 12 of the shotgun 8 can be too hot and also dirty for an individual to handle with their hands.

While preferred embodiments have been shown and described, it will be understood that there is no intent to limit the invention to such disclosure.

What is claimed is:

1. An apparatus for installing, removing and storing a shotgun choke, comprising:

an outer part having an opening sized to hold a shotgun choke;

an inner part slidably connected to said outer part for movement from a position in which the majority of said inner part is within said opening to a position in which the majority of said inner part is outside said opening; said inner part having means for releasably retaining the shotgun choke; and a wrench engageable with the outboard end of the shotgun choke, said wrench being mounted on said inner part, said wrench and said outer part connected to rotate together whereby said outer part in combination with said wrench may be used as a choke wrench to remove or install the shotgun choke.

2. The apparatus of claim 1, wherein said inner part includes resilient fingers for contact with the interior walls of a shotgun choke to hold the shotgun choke in place during installation, removal and storage.

3. The apparatus of claim 1, wherein said outer part is a tube having a slot through the outer wall running from adjacent the one end to adjacent the other end thereof; said inner part including a thumb button sized to fit through said slot whereby a user may extend and retract said inner part by moving the button along the slot.

4. An apparatus for installing, removing and storing a shotgun choke, comprising:

an outer part having an opening sized to hold a shotgun choke;

an inner part connected to said outer part for movement into and out of said opening, said inner part having means for releasably retaining the shotgun choke;

a wrench engageable with the outboard end of the shotgun choke; said wrench and said outer part connected to rotate together whereby said outer part in combination with said wrench may be used as a choke wrench to remove or install the shotgun choke;

a spring loaded releasable retaining means; and ball bearings allowing the said inner part to move with ease from entirely within said outer part to a position where said inner part is only partially inside said outer part and is extended to act as a wrench.

5. The apparatus as defined in claim 4, wherein said releasable retaining means comprises:

a detent ball and a spring located in the said inner part such that the said detent ball and said spring lock with said outer part in either the position where said apparatus acts as the wrench or the case.

6. The apparatus as defined in claim 5, wherein said outer part is comprised of a tube or thin walled cylinder having:

a groove on its interior running longitudinally parallel to an axis through the center of the said outer part; and two holes in the wall of said outer part, one hole located towards each end of said outer part and both holes lying on a longitudinal line on the opposite side of said cylinder from said groove.

7. The apparatus as defined in claim 6, wherein:

the said inner part is a cylinder including a solid base portion which fits snugly within the said outer part, having a hole on one side to house said spring and said detent ball, and also having two holes on the opposite side for said ball bearings;

a wrench portion having a wrench located where said wrench portion and said base portion meet, having a smaller diameter than said base section, and also having a hollow center and slits running lengthwise to form resilient fingers; and an end portion having a hollow center and slits the same as the said wrench portion, with a larger diameter such that it can fit snugly inside of a choke and hold the choke.

8. The apparatus as defined in claim 7, wherein the said wrench portion comprises a pair of drive lugs.

9. An apparatus for installing, removing and storing a shotgun choke, comprising:

an elongated tube having two ends and sized to hold a choke;

an elongated inner member slidable from a position within said tube to a position wherein a portion of said inner member extends outside one end of said tube;

a wrench member, said outer tube and said wrench member connected to rotate together; and said inner member including at least one element extending therefrom for contact with an interior wall of said choke to be installed or removed.

* * * * *